US006784878B2

(12) United States Patent
Hanari et al.

(10) Patent No.: US 6,784,878 B2
(45) Date of Patent: Aug. 31, 2004

(54) FLAT-PANEL DISPLAY DEVICE

(75) Inventors: Jun Hanari, Yokohama (JP); Manabu Watanabe, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 135 days.

(21) Appl. No.: 10/186,700

(22) Filed: Jul. 2, 2002

(65) Prior Publication Data

US 2003/0006977 A1 Jan. 9, 2003

(30) Foreign Application Priority Data

Jul. 4, 2001 (JP) ..... 2001-203648

(51) Int. Cl.[7] ..... F09G 5/00
(52) U.S. Cl. ..... 345/204
(58) Field of Search ..... 345/204–206, 345/211–214, 55, 76, 82, 87, 98, 531, 545, 547, 564, 629

(56) References Cited

U.S. PATENT DOCUMENTS 5,357,267 A * 10/1994 Inoue ..... 345/531

5,945,972 A * 8/1999 Okumura et al. ..... 345/98

* cited by examiner

*Primary Examiner*—Alexander Eisen
(74) *Attorney, Agent, or Firm*—Oblon, Spivak, McClelland, Maier & Neustadt, P.C.

(57) ABSTRACT

A flat-panel display device includes a matrix array of display pixels which respectively have memory elements, a vertical decoder which selectively designates row blocks of the display pixels, a horizontal decoder which selectively designates column blocks of the display pixels, a video RAM which stores image data respectively assigned to the memory elements, and a controller which controls the vertical and horizontal decoders to write the contents of the video RAM in units of blocks specified by row and column block addresses. The device further includes an interface which determines a rewriting range corresponding to at least one block of the display pixels including display pixels for part of the image data when the part is updated in the video RAM, and supplies to the controller the image data assigned to each block included in the rewriting range.

5 Claims, 5 Drawing Sheets

FLAT-PANEL DISPLAY DEVICE

CROSS-REFERENCE TO RELATED APPLICATIONS

This application is based upon and claims the benefit of priority from the prior Japanese Patent Application No. 2001-203648 filed Jul. 4, 2001, the entire contents of which are incorporated by reference.

BACKGROUND OF THE INVENTION

1. Field of the Invention

The present invention generally relates to a flat-panel display device including a matrix array of display pixels, and more particularly to a flat-panel display device in which each of the display pixels has a memory element for storing image data.

2. Description of the Related Art

In recent years, active matrix liquid crystal display panels have been widely used as a monitor display for a note PC or a mobile communication terminal in view of excellent display and high reliability as a product. The liquid crystal display panel is generally formed of an array substrate in which a plurality of pixel electrodes are arrayed in a matrix, a counter substrate in which a counter electrode disposed to face the pixel electrodes and a liquid crystal layer held between the array substrate and the counter substrate. The array substrate includes, in addition to the pixel electrodes, a plurality of scanning lines disposed along rows of the pixel electrodes, a plurality of signal lines disposed along columns of the pixel electrodes and a plurality of pixel switches disposed near intersections of the scanning lines and the signal lines. Each of the pixel switches is connected so as to apply a signal voltage of a corresponding signal line to a corresponding pixel electrode when driven via a corresponding scanning line. With a use of the pixel switches, a crosstalk between neighboring pixels can be sufficiently reduced and an image with high contrast can be obtained.

The pixel switch is generally formed of a thin film transistor having a semiconductor thin film of amorphous silicon. Recently, as a result of progress in manufacturing technology, the semiconductor thin film can be of polysilicon, whose carrier mobility is higher than the amorphous silicon. With the thin film forming technique, not only the pixel switches for pixel electrodes, but also a vertical driver and a horizontal driver, for example, can be formed on the array substrate.

As mobile communication terminals such as a portable phone or the like generally operate by power from a battery, it is preferable that power consumption is as low as possible. To suppress the power consumption, the brightness of a display screen is usually decreased while the portable phone is in a standby state waiting for an incoming call. In recent years, there is another known technique of causing the vertical driver and the horizontal driver to be unused. With this technique, a plurality of memory elements are disposed in display pixels constituting the display screen and store image data representing a static image to be displayed in the standby state. The vertical driver and the horizontal driver are suspended while the static image is displayed based on the contents of the memory elements. As a result, power consumption of display can be suppressed.

Nevertheless, when the vertical driver and the horizontal driver are fully suspended, it is difficult to update part of the displayed image.

BRIEF SUMMARY OF THE INVENTION

In light of the above-described technical drawbacks, an object of the present invention is to provide a flat-panel display device which can update part of display image at low consumption power.

According to one aspect of the present invention, there is provided a flat-panel display device comprising: a matrix array of display pixels which respectively have memory elements and display an image corresponding to contents of the memory elements; a vertical scanning circuit which selectively designates row blocks of the display pixels to enable writing into the memory elements corresponding to a designated row block; a horizontal scanning circuit which selectively designates column blocks of the display pixels to write image data into the memory elements corresponding to a designated column block; an interface which accesses a video memory for each display pixel to set and retrieve address and image data supplied externally; and a controller which controls the vertical scanning circuit and horizontal scanning circuit with reference to the address data and image data supplied from the interface; wherein the interface has an operation mode of detecting address data for part of the display pixels corresponding to the image data supplied externally and different from the image data stored in the video memory, determining a rewriting range of the row and column blocks including the part of the display pixels specified by detected address data, and supplying partial image data corresponding to the rewriting range to the controller.

With the flat-panel display device, addressing of the vertical scanning circuit and the horizontal scanning circuit can be simplified since the interface determines a rewriting range of the row and column blocks including part of the display pixels specified by address data corresponding to image data supplied externally. Thus, even if the part is short for rewriting to each block of the display pixels, shortage of image data can be supplemented by the contents of the video memory. Namely, when image data of an addressing form is externally supplied to update part of the image data stored in the video memory, the addressing form can be adapted for an addressing system of the controller. Accordingly, a part of the displayed image can be updated without requiring power consumption as compared with the case where the memory elements of all the display pixels are rewritten.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

A flat-panel display device according to one embodiment of the present invention will be described hereinafter with reference to the accompanying drawings. The flat-panel display device is configured so as to be operable in a normal write mode for updating an image on the entire display screen and in a random write mode for updating a part of the image in units of blocks.

Figure 1:
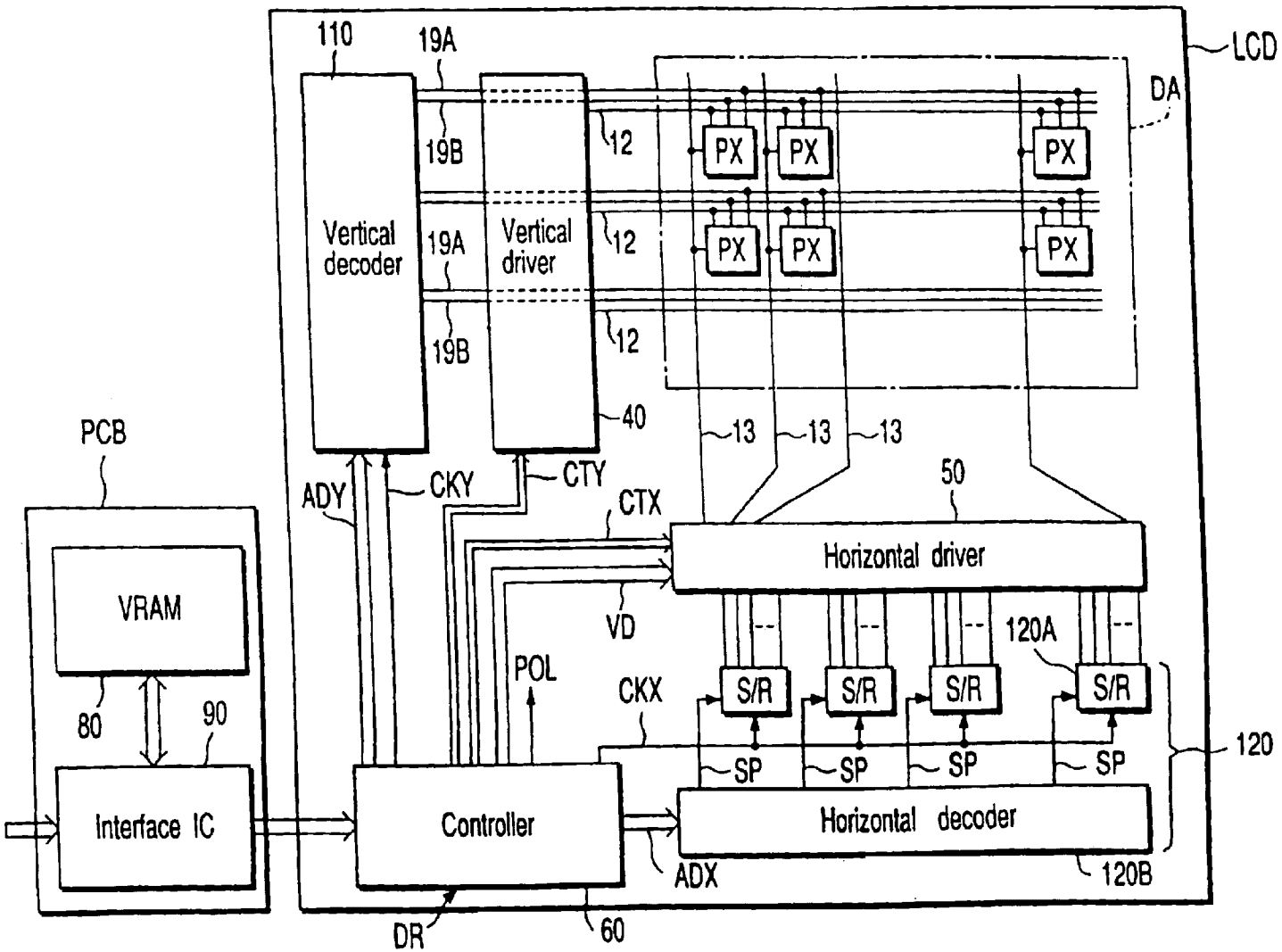
FIG. 1 is a circuit diagram schematically showing a configuration of a flat-panel display device according to one embodiment of the present invention.
Figure 2:
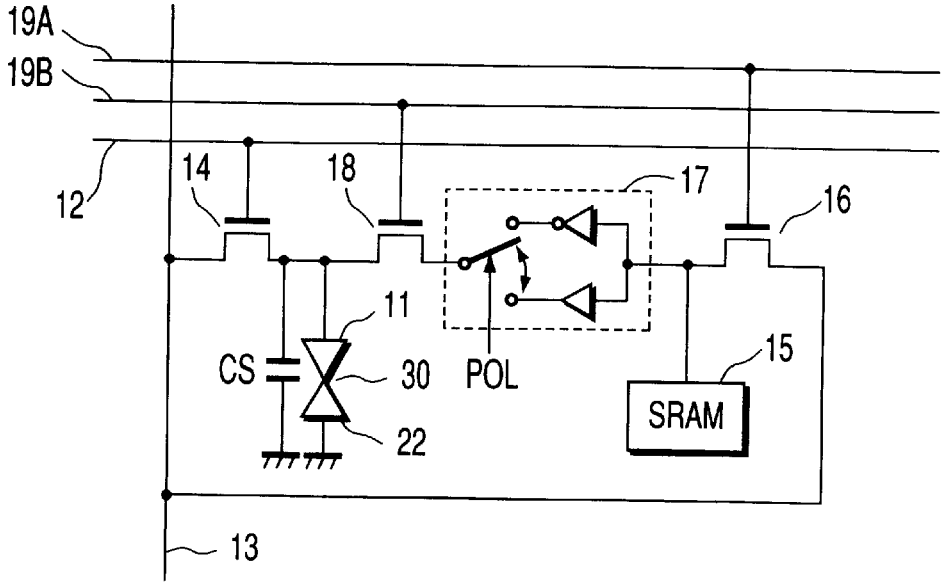
FIG. 2 is a circuit diagram showing a configuration of a display pixel of a liquid crystal display panel shown in FIG. 1.
Figure 3:
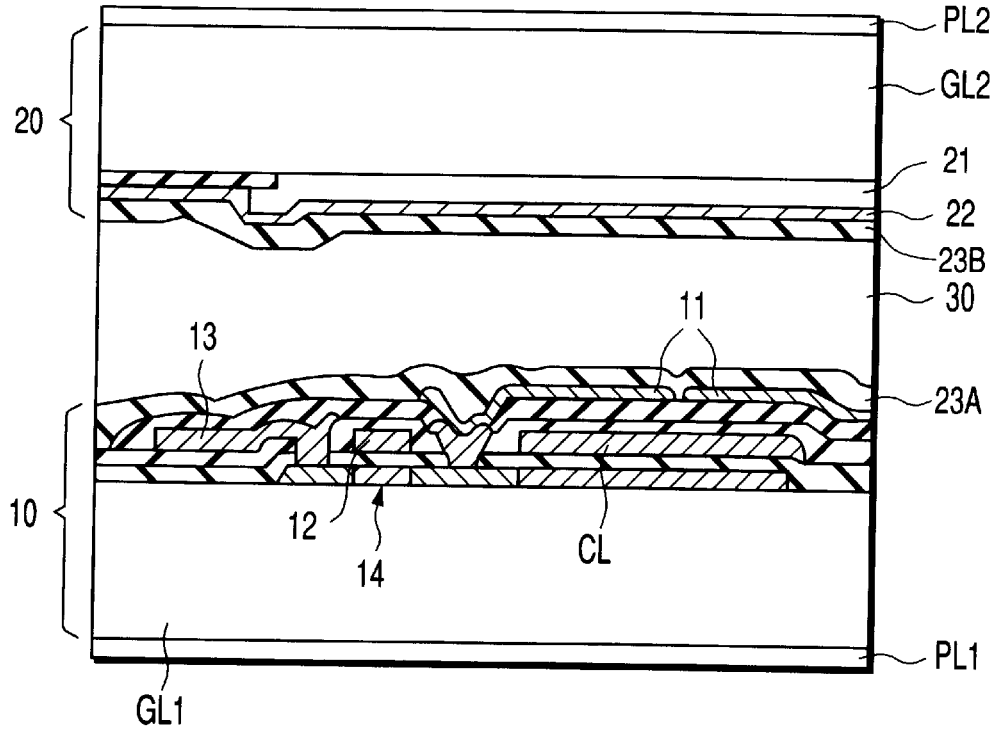
FIG. 3 is a view showing a partial cross-sectional structure of the display pixel shown in FIG. 2.

FIG. 1 schematically shows a configuration of the flat-panel display device. FIG. 2 shows a configuration of a display pixel of a liquid crystal display panel shown in FIG. 1. FIG. 3 shows a partial cross-sectional structure of the display pixel shown in FIG. 2.

The flat-panel display device comprises a reflection type liquid crystal display panel LCD including a display area DA formed by a matrix array of display pixels PX and a driver area DR formed for driving the display pixels PX and an external control circuit PCB for controlling the liquid crystal display panel LCD. The liquid crystal display panel LCD includes an array substrate 10, a counter substrate 20 opposing the array substrate 10 and a liquid crystal layer 30 serving as a light modulation layer and held between the array substrate 10 and the counter substrate 20. The liquid crystal layer 30 is obtained by injecting a liquid crystal composition into a clearance between the array substrate 10 and the counter substrate 20 and sealing the composition therein. A light transmittance of the liquid crystal layer 30 is set according to a potential difference between a pixel electrode 11 and a counter electrode 22. The array substrate 10 and the counter substrate 20 respectively have polarization plates PL1 and PL2 affixed to their outer surfaces.

The counter substrate 20 has a light transmitting insulation substrate GL2 such as a glass plate or the like, a color filter 21 formed on the insulation substrate GL2, a counter electrode 22 opposing a plurality of pixel electrodes 11 and covering the color filter 21 and an alignment film 23A covering the counter electrode 22.

Next, the array substrate 10 will be described. The display area DA of the array substrate 10 has a light transmitting insulation substrate GL1 such as a glass plate or the like, a plurality of pixel electrodes 11 arranged so as to correspond to the display pixels PX, a plurality of scanning lines 12 arranged along rows of these pixel electrodes 11, a plurality of signal lines 13 arranged along columns of the pixel electrodes 11 and a plurality of pixel switches 14 arranged near intersections of the scanning lines 12 and the signal lines 13. Further, the display area DA has input and output gate lines 19A and 19B arranged in parallel to the scanning lines 12 and extending in a column direction of the display pixels PX, memory input switches 16 placed near intersections of the signal lines 13 and the input gate lines 19A, memory elements 15 such as static RAMs connected to the memory input switches 16, for holding image data VD supplied from the corresponding signal lines 13 and memory output switches 18 connected to the memory elements 15 via polarity inversion circuits 17. The pixel switches 14 and the memory output switches 18 are connected to storage capacitances CS each formed by capacitive coupling between a corresponding pixel electrode 11 and a corresponding storage capacitance line placed in parallel with the corresponding scanning line 12. The image data is written into the pixel electrodes 11 and the storage capacitances CS, via the pixel switches 14 in the normal write mode and via the memory output switches 18 in the random write mode.

Each of the pixel switches 14 and memory output switch 18 are formed of a thin film transistor formed on the insulation substrate GL1 using a semiconductor thin film made of polysilicon, and is made conductive to apply a signal voltage of the corresponding signal line 13 to the corresponding pixel electrode 11 when driven via the corresponding scanning line 12 or the output gate line 19B.

As in the same manner as the counter substrate 20, the plurality of pixel electrodes 11 are covered by the alignment film 23B as shown in FIG. 3.

The drive area DR of the array substrate 10 includes a vertical driver 40 which drives the plurality of scanning lines 12, a horizontal driver 50 which drives the plurality of signal lines 13, a vertical decoding section110 which controls an operation of the vertical driver 40 for each row, a horizontal decoding section 120 which controls an operation of the horizontal driver 50 for each column, and a controller 60 which controls the vertical and horizontal decoding sections 110 and 120 to operate synchronously.

The vertical driver 40, the horizontal driver 50, the controller 60, the vertical decoding section 110 and the horizontal decoding section 120 are disposed outside the display area DA for display pixels PX and have thin film transistors serving as segments and formed in the same manufacturing step as the pixel switches 14 using a semiconductor thin film of polysilicon.

The external control circuit PCB is formed by a video RAM 80 and an interface IC 90 which are placed on a printed wiring board provided outside the liquid crystal display panel LCD. The video RAM 80 stores address data and image data for one frame to be written into the display pixels PX. The interface IC 90 temporarily sets the address data and image data supplied externally into the video RAM 80, sequentially retrieves the data from the video RAM 80 according to the operation mode, and supplies the data to the controller 60 of the liquid crystal display panel LCD. More specifically, in the normal write mode, the address data and image data for all display pixels PX are outputted to the controller 60. In the random write mode, the address data and image data for blocks to be rewritten are outputted, as block address data and update image data to the controller.

Next, a display operation in the normal write mode will be described. The controller 60 supplies to the vertical driver 40 a vertical scanning control signal CTY such as a vertical start pulse and vertical clock pulses generated synchronously to a frame period of an image in the normal write mode. Further, the controller 60 supplies to the horizontal driver 50 the image data VD which are polarity-inverted for each frame period or each horizontal scanning period of the image, and a horizontal scanning control signal CTX such as a horizontal start pulse and horizontal clock pulses generated synchronously to the horizontal scanning period. The vertical driver 40 sequentially drives the scanning lines 12 by shifting the vertical start pulse in response to each vertical clock pulse. On the other hand, the horizontal driver 50 sequentially drives the signal lines 13 by shifting the horizontal start pulse in response to each horizontal clock pulse. In this way, while the display pixels PX of each row are driven, the image data is written into the pixel electrodes 11 of the display pixels PX, thereby setting the potential of the pixel electrodes 11. The memory input switches 16 and the memory output switches 18 operate in the normal write mode to write the image data supplied to the signal lines 13 into the memory elements 15 and supply voltages of the image data to the pixel electrodes 11.

Figure 5:
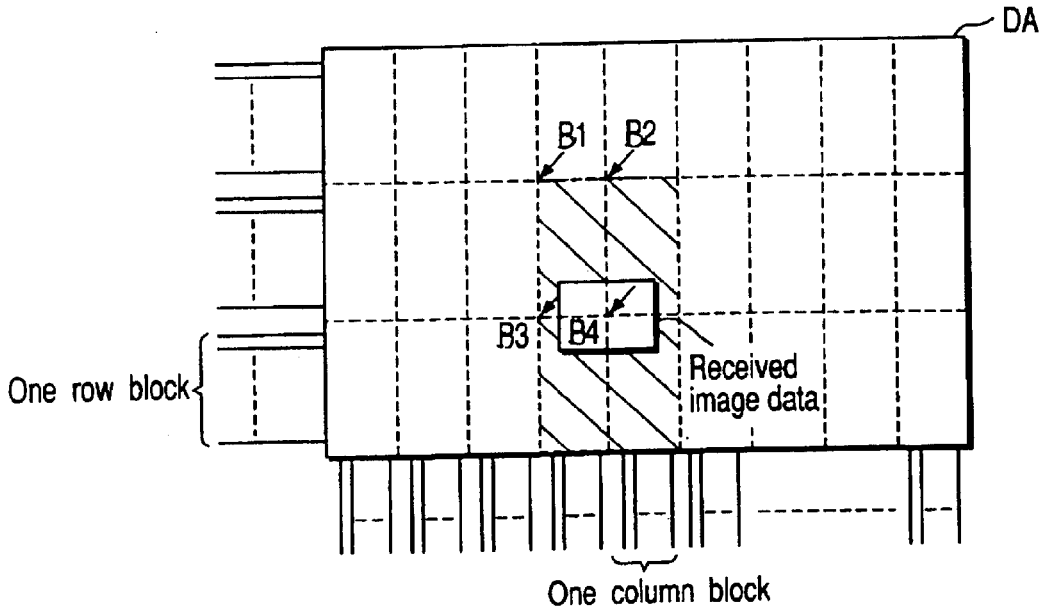
FIG. 5 is a view showing a rewriting range determined for received image data shown in FIG. 4.

Next, a display operation in the random write mode will be described. FIG. 5 shows an example of a rewriting range determined for received image data.

Block address data of each of blocks corresponding to a rewriting range and the update image data for each block are supplied from the interface IC of the external drive circuit PCB to the controller. In the example shown in FIG. 5, four blocks of the display pixels PX shown by slant lines are set as a rewriting range. The block address data indicating top positions B1 through B4 of these blocks and the update image data specified by the block address data are sequentially supplied to the controller 60.

The controller 60 generates a vertical address signal ADY and a horizontal address signal ADX based on the block address data. Then, the controller 60 supplies the vertical clock signal CKY and the vertical address signal ADY to the vertical decoding section 110, and the horizontal address signal ADX and the horizontal clock signal CKX to the horizontal decoding section 120. Further, the controller 60 is structured so as to supply the polarity-inverted signal POL which is inverted every a predetermined period such as the frame period or the horizontal scanning period to the polarity inversion circuit 17.

Then, the vertical decoding section 110 sequentially selects rows of the display pixels PX of a row block corresponding to the vertical address signal ADY to drive the corresponding gate lines 19A and 19B. While the display pixels of each row are selected, the horizontal decoding section 120 sequentially selects columns of the display pixels PX of a column block corresponding to the horizontal address signal ADX to control the horizontal driver 50 so as to drive the corresponding signal line 13. The horizontal driver 50 supplies, by control of the horizontal decoding section 120, the image data supplied from the controller 60 to the signal line 13 corresponding to the display pixels PX of the selected column.

More specifically, the horizontal decoding section 120 includes a shift register circuit 120A formed of shift registers S/R connected in tandem such that the display pixels PX are divided into column blocks, and a horizontal decoder 120B for decoding the horizontal address signal ADX. The horizontal decoder 120B outputs a scanning pulse SP to the shift register S/R corresponding to the horizontal address signal ADX. The shift register S/R shifts the scanning pulse SP in response to the horizontal clock signal CKX and controls the horizontal driver 50 to sequentially drive the signal lines 13 corresponding to the number of display pixels in the column block.

A structure of the vertical decoding section 110 is almost the same as that of the horizontal decoding section 120, and includes a shift register circuit formed of shift registers connected in tandem such that the display pixels PX are divided into row blocks, and a vertical decoder for decoding the vertical address signal ADY. The vertical decoder outputs a scanning pulse to the shift register corresponding to the vertical address signal ADY. The shift register shifts the scanning pulse in response to the vertical clock signal CKY and sequentially drives the input gate lines 19A and the output gate lines 19B corresponding to the number of display pixels in the row block. The input gate line 19A and the output gate line 19B are set so as to have a complementary potential relationship.

At the display pixel PX, in a state that the pixel switch 14 is turned off, the memory input switch 16 is driven via the input gate line 19A and the memory output switch 18 is driven via the output gate line 19B. The polarity inversion circuit 17 is controlled by a polarity-inverted signal POL from the controller 60.

The memory input switch 16 is conducted prior to the memory output switch 18 and writes the image data on the signal line 13 into the memory element 15. When writing has been completed, the memory output switch 18 is conducted instead of the memory input switch 16. Thus, the image data is supplied via the polarity inversion circuit 17 from the memory element 15 to the pixel electrode 11. The polarity inversion circuit 17 periodically inverts a voltage polarity of the image data.

With the above-described structure, once the whole image is displayed in the normal write mode, then part of the image may be modified in the random write mode. In the random write mode, operations of the vertical driver 40 and the horizontal driver 50 can be partially restricted or suspended by the controller 60 controlling supply of the clock signal.

Figure 4:
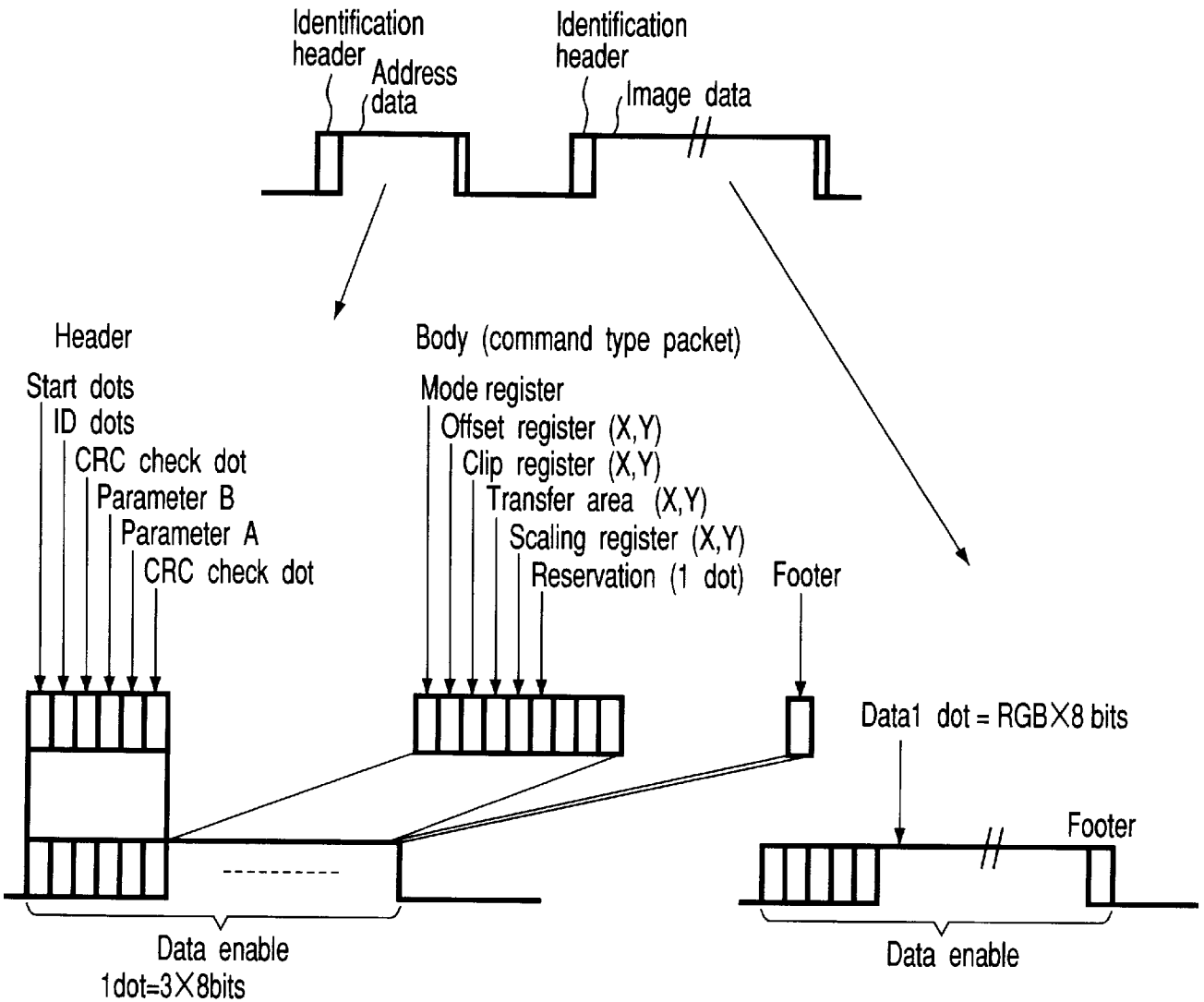
FIG. 4 is a view showing a format of a packet to be externally supplied to an interface IC shown in FIG. 1.

Next, description will discuss about data transfer from a computer set serving as an image data source to the external drive circuit PCB. Data is transferred from the computer set to the external control circuit PCB, for example, in the packet form as shown in FIG. 4. Here, data such as address data and image data are transferred as one set for each dot formed, for example, of R, G, B display pixels PX.

For example, data from the computer set to the external drive circuit PCB are transferred in a different manner switched between the normal write mode and the random write mode. In the normal write mode, data for all display pixels are transferred in the packet form. In the random write mode, data for part of the display pixels to be modified with respect to the prior frame (which hereinafter is referred to as received data) are transferred in the packet form. The interface IC 90 sets the received data in the video RAM 80 to update part of the image data stored therein, and outputs to the controller partial image data assigned to each block of the display pixels including display pixels for the updated part of the image data.

Figure 6:
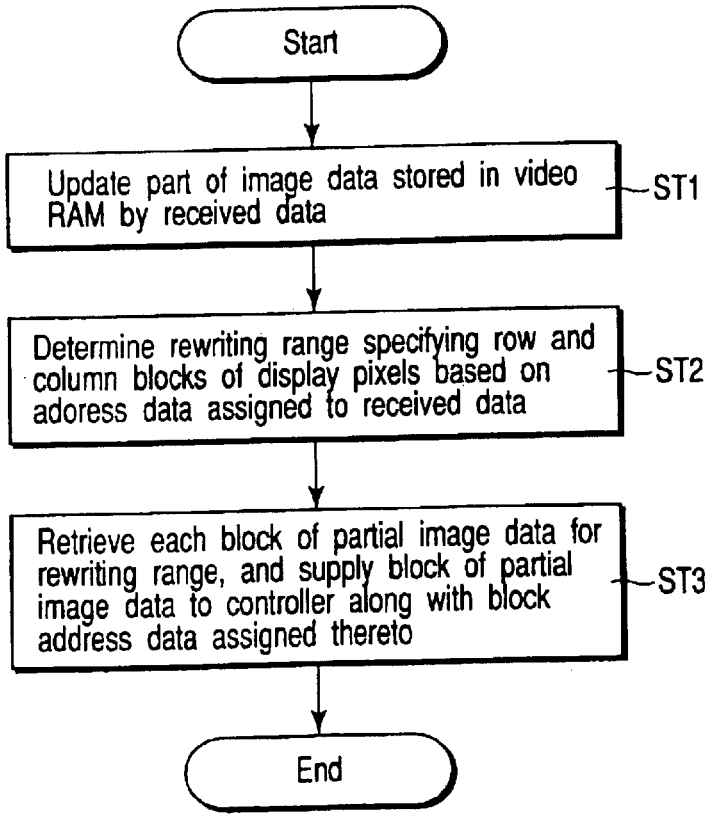
FIG. 6 is a flowchart showing a detailed operation performed in random write mode by an the interface IC shown in FIG. 1.

FIG. 6 shows a detailed operation of the interface IC 90 performed in the random write mode. The interface IC 90 updates, in step ST1, part of the image data stored in the video RAM 80 by the received data, determines, in step ST2 based on the address data assigned to the received data, a rewriting range corresponding to at least one block of the display pixels PX including display pixels for updated part of the image data, and supplies, in step ST3 to the controller 60, partial image data VD assigned to each block included in the rewriting range, along with block address data assigned to the partial image data VD. As the received data correspond only to part of the image data assigned to at least one block of the display pixels included in the rewriting range, the contents of the video RAM 80 are used for supplementing the received data, which is short for rewriting to each block of the display pixels.

With the flat-panel display device, addressing of the vertical decoder 110 and the horizontal decoder 120 can be simplified since the rewriting range is defined by at least one block of display pixels PX including display pixels PX for part of the image data when the part is update in the video RAM 80. On the other hand, the interface IC 90 can supply from the video RAM 80 the image data assigned to each block included in the rewriting range. Thus, even if the updated part is short for rewriting to each block of the display pixels PX, shortage of image data can be supplemented by the contents of the video RAM 80. Namely, when image data of an addressing form is externally supplied to update part of the image data stored in the video RAM 80, the addressing form can be adapted for an addressing system of the controller 60. Accordingly, a part of the displayed image can be updated without requiring power consumption as compared with the case where the memory elements 15 of all the display pixels PX are rewritten.

The present invention is not limited to the above-described embodiment and can be variously modified.

For example, in the embodiment, it has been described that data transfer from the computer set to the interface IC 90 is different depending on the operation mode. Nevertheless, the data of one frame may be transferred from the computer set to the interface IC 90 irrespective of the operational mode. In this case, at the interface IC 90, data of the prior frame stored in the video RAM 80 is read out, and the received data is stored in the video RAM 80. Then, the image data of the prior frame is compared to the image data of the next frame to detect updated part. When updated part is detected, the control of rewriting operation is performed in the normal write mode or the random write mode. It is desirable that one of the normal write mode and the random write mode is selected depending on applications of the flat-panel display device. In a case of the rewriting operation in the random write mode, the image data assigned to the display pixels PX of all blocks including the updated part are supplied to the controller 60 along with the block address data.

In a case of rewriting operation in the random write mode, image data assigned to each of blocks of display pixels PX corresponding to the updated part can be supplied to the controller 60 along with the block address data. Thus, consumption power required for transferring data between the external drive circuit PCB and the liquid crystal display panel LCD can be reduced. Further, in the liquid crystal display panel LCD, the consumption power can be further reduced by a control of operating only portions of the drivers related to the block to be rewritten.

Further, in a case where the random write mode continues for a predetermined period of time or longer, all of the display pixels PX may be periodically rewritten to update part of the image displayed in the display area DA.

Although the flat-panel display device utilizing a liquid crystal display panel LCD has been described in the above embodiment, the present invention may be applied to all active matrix type display devices such as an organic EL display panel and the like.

Figure 7:
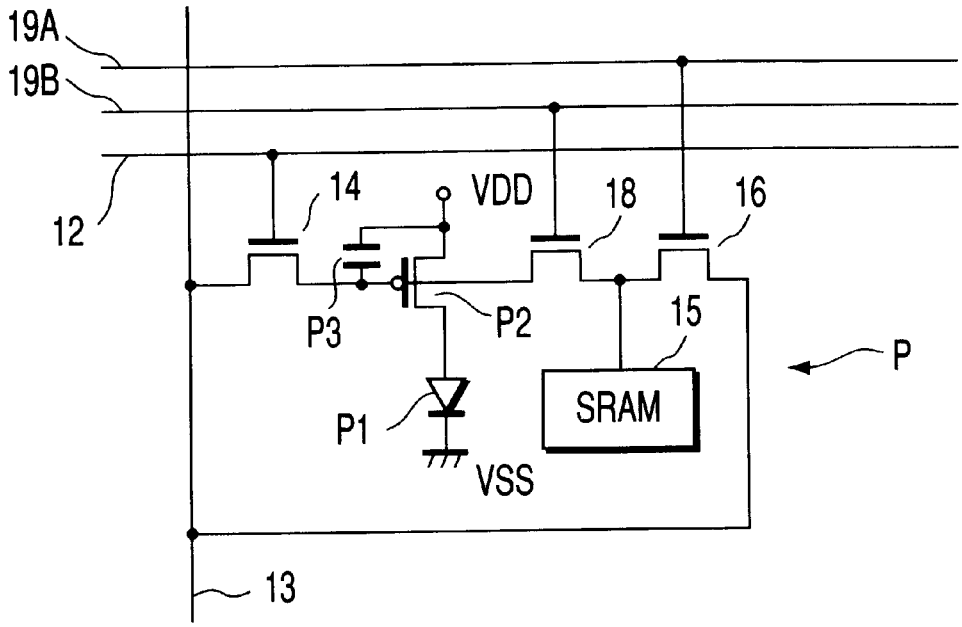
FIG. 7 is a circuit diagram showing a configuration of a display pixel of an organic EL panel as a first modification of the flat-panel display device shown in FIG. 1.
Figure 8:
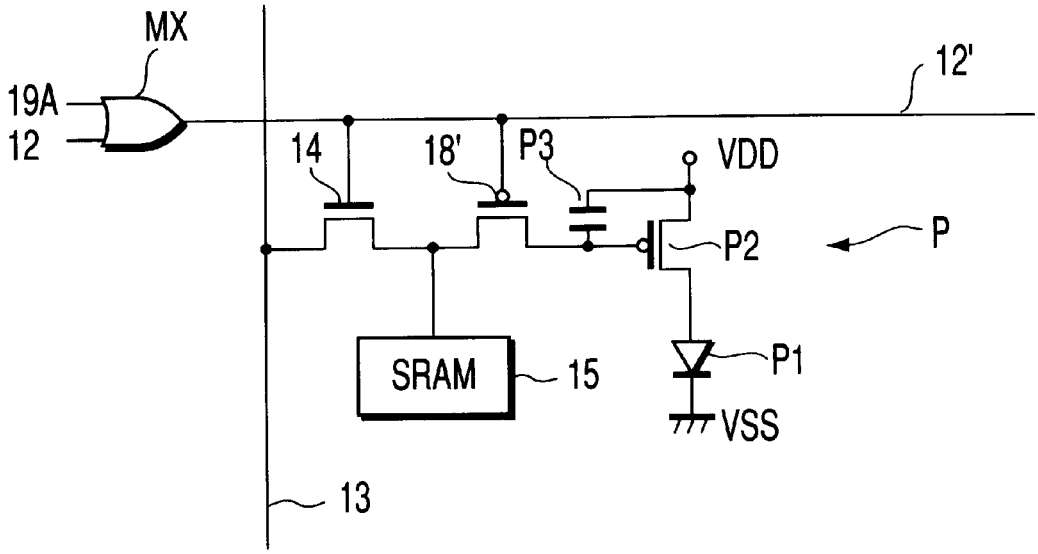
FIG. 8 is a circuit diagram showing a display pixel of an organic EL panel as a second modification of the flat-panel display device shown in FIG. 1.

For example, when the present invention is applied to the organic EL display panel, the polarity inversion circuit 17 shown in FIG. 2 is unnecessary. The present invention may be structured by using display pixels P as shown in FIG. 7. In this example, the display pixel P comprises an organic EL light emitting element P1, a drive transistor P2 formed of a P channel thin film transistor connected in series with the organic EL light emitting element P1 between power terminals VDD and VSS, and a capacitor P3 connected between a source and a gate of the drive transistor P2. Alternatively, the present invention may be structured as shown in FIG. 8, so that the number of wirings can be reduced. In this example, an OR-gate circuit MX is commonly connected to the gate line 19A driven by the vertical decoder 110 and the scanning line 12 driven by the vertical driver 40. An output line 12' of the or-gate circuit MX is connected to a gate of the pixel switch 14 formed of an N channel thin film transistor and a gate of a memory output switch 18' formed of a P channel thin film transistor. The memory element 15 is connected between the pixel switch 14 and the memory output switch 18'. When the output line 12' of the or-gate circuit MX rises to a high level, the pixel switch 14 is conducted and the memory output switch 18' is not conducted. Thus, image data is written from the signal line 13 into the memory element 15 via the pixel switch 14. When the output line 12' of the or-gate circuit MX falls to a low level, the pixel switch 14 is not conducted and the memory output switch 18' is conducted. Thus, the image data is supplied from the memory element 15 to the gate of the drive transistor P2 via the memory output switch 18'.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat-panel display device comprising:

a matrix array of display pixels which respectively have memory elements and display an image corresponding to contents of the memory elements;

a vertical scanning circuit which selectively designates row blocks of the display pixels to enable writing into the memory elements corresponding to a designated row block;

a horizontal scanning circuit which selectively designates column blocks of the display pixels to write image data into the memory elements corresponding to a designated column block;

an interface which accesses a video memory for each display pixel to set and retrieve address and image data supplied externally; and a controller which controls said vertical scanning circuit and horizontal scanning circuit with reference to the address data and image data supplied from said interface;

wherein said interface has an operation mode of detecting address data for part of the display pixels corresponding to the image data supplied externally and different from the image data stored in said video memory, determining a rewriting range of the row and column blocks including the part of the display pixels specified by detected address data, and supplying partial image data corresponding to the rewriting range to said controller.

2. The flat-panel display device according to claim 1, wherein said interface is configured to set image data supplied thereto to update part of the image data stored in said video memory and retrieve the image data assigned to each block included in the rewriting range.

3. The flat-panel display device according to claim 1, wherein said interface is configured to retrieve the image data stored in said video memory as that of prior frame, and compare the image data of the prior frame with image data of next frame supplied thereto to detect the updated part of the image data.

4. The flat-panel display device according to claim 1, wherein said interface is configured to receive image data supplied in a packet form.

5. The flat-panel display device according to claim 1, wherein said partial image data are a combination of image data supplied externally and image data selected from the image data assigned to each block included in the rewriting range to supplement the externally supplied image data.

* * * * *